United States Patent [19]

Toker et al.

[11] Patent Number: 4,871,402

[45] Date of Patent: Oct. 3, 1989

[54] SEPARATING-AGENT COMPOSITION AND METHOD USING SAME

[75] Inventors: Nazmi Toker, Monroeville; Leroy R. Price, Allison Park, both of Pa.

[73] Assignee: Allegheny Ludlum Corporation, Pittsburgh, Pa.

[21] Appl. No.: 209,593

[22] Filed: Jun. 21, 1988

Related U.S. Application Data

[62] Division of Ser. No. 947,002, Dec. 29, 1986, Pat. No. 4,781,769.

[51] Int. Cl.[4] ..... B05D 1/00

[52] U.S. Cl. ..... 148/113; 148/18; 148/28; 427/127

[58] Field of Search ..... 148/113, 18, 27, 28; 427/127

[56] References Cited

FOREIGN PATENT DOCUMENTS 96278 6/1984 Japan ..... 148/27

44395 10/1985 Japan ..... 148/113

*Primary Examiner*—L. Dewayne Rutledge

*Assistant Examiner*—George Wyszomierski

*Attorney, Agent, or Firm*—Patrick J. Viccaro

[57] ABSTRACT

By adding an appropriate amount, 1 to 12 weight percent, based on the amount of magnesium oxide present and Loss On Ignition values of powdered magnesium metal to the magnesium oxide aqueous slurry composition used to make a separating-agent composition in the making of grain-oriented silicon electrical steel, there are obtained composition, an article, and a method characterized principally by a substantial decrease in the rate of rejections of the product of the final texturizing anneal because of coating defects—such difficulties as bare spots, and metal-overlay pattern. Moreover, the magnetic properties may be improved because of improved control of the propagation of the internally oxidized zone of the steel.

11 Claims, 1 Drawing Sheet

SEPARATING-AGENT COMPOSITION AND METHOD USING SAME

This is a division of Application Ser. No. 947,002, filed Dec. 29, 1986, now U.S. Pat. No. 4,781,769, issued Nov. 1, 1988.

FIELD OF THE INVENTION

This invention relates to the making of grain-oriented silicon electrical steel, and in particular, it relates to compositions of matter which are used as a separating agent to prevent adjacent laps of coiled steel from becoming adhered to each other during the step of annealing the coiled steel to develop therein the desired grain-oriented texture. In one aspect, the invention may be considered as being a composition of matter, the slurry which is used to produce such a separating-agent coating on the steel. In another aspect, the invention may be considered as being an article of manufacture, namely, the steel in strip form having thereon a dried coating made from a slurry having such a composition. In still another aspect, the invention may be viewed as being a method comprising the steps of compounding a suitable slurry composition, applying it to the steel, drying it, coiling the steel, and effecting the texturizing anneal heat treatment with use of separating-agent composition mentioned above.

DESCRIPTION OF THE PRIOR ART

Those skilled in the art of making grain-oriented silicon electrical steel are, of course, familiar with the general practice of applying the steel in strip form, at a stage near to the end of the multi-step process for making that product, i.e., just before the final texturizing-anneal heat treatment, a separating-agent composition which is usually in the nature of an aqueous slurry in which the principal ingredient is usually magnesium oxide. A typical prior-art slurry composition may be made by mixing 50 pounds of finely divided magnesium oxide, 600 grams of magnesium sulfate heptahydrate (Epsom Salts), and 40 gallons of water. In accordance with the prior art, such a composition is applied to steel strip having a thickness on the order of 5 to 20 mils under conditions to yield a separating-agent coating having, in its as-dried condition, a coating weight on the order of 0.010 to 0.050 ounces per square foot. In its as-dried condition, the separating-agent coating so produced is not completely anhydrous; it has a Loss On Ignition (LOI) on the order of 1.1 to 1.5 percent. The silicon steel having such a coating on it is coiled up and given a final texturizing anneal under conditions of up to 2300 degrees F. in an atmosphere of hydrogen and nitrogen with a dew point of about 0 degrees F.

Ideally, there is developed on the surface of the silicon steel during the texturizing annealing a uniform insulating film of forsterite ($Mg_2SiO_4$). As is well known to those skilled in the art, however, the above-indicated prior-art practice yields results which are less than ideal a disappointingly large percentage of the time, about 15 to 40 percent. Sometimes, there are developed "islands" or "bare spots" in the desired insulating coating; sometimes, there is a metal overlay pattern developed during the final anneal. Although the known practice yields a desirable or tolerable results well over half of the time, the economic losses caused by rejections because of coating defects, i.e., made necessary because of non-ideal performance of the separating-agent composition, are very substantial.

The prior art contains patents which recognize the advisability of adding different agents to the slurry consisting principally of magnesium oxide and water. Thus, for example, there are U.S. Pat. Nos. 3,544,396 and 3,615,918, which prescribe the use of $Cr_2O_3$ and $P_2O_5$, respectively, as additives to the magnesium oxide coating slurry. U.S. Pat. No. 4,582,547 discloses the use of an inert, high temperature refractory annealing separator agent selected from the group consisting of fully calcined alumina, zirconia, chromic oxide, magnesium oxide and calcium. Japanese Pat. No. 44395 of 1985 teaches adding to the magnesium oxide slurry about 1 to 10 weight percent, based on the magnesia, of a powder of a metal which is described as having a free energy of oxide formation (oxidation potential) that is higher than iron and selected from the group consisting of aluminum, silicon, titanium, chromium, zirconium, niobium, tin, tungsten, and molybdenum. The patent indicates such additions as made to improve the magnetic properties of the product and to maintain the uniformity of the oxide film on its surface by adjusting the oxidation potential of the high-temperature annealing conditions. The patent does not specifically mention magnesium metal as an addition to the MgO slurry, nor does it mention any particular degree of fineness of the metal powder which is added.

SUMMARY OF THE INVENTION

By adding an appropriate amount (1 to 12 weight percent, based on the amount of magnesium hydroxide present), of powdered magnesium metal to the magnesium oxide aqueous slurry composition used to make a separating-agent composition in the making of grain-oriented silicon electrical steel, there are obtained a composition, an article, and a method characterized principally by a substantial decrease in the rate of rejections of the product of the final texturizing anneal because of coating defects—such defects as bare spots and metal-overlay pattern. Moreover, the magnetic properties may be improved because of improved control of the propagation of the internally oxidized zone of the steel.

DESCRIPTION OF THE DRAWINGS

A complete understanding of the invention may be obtained from the foregoing and following description thereof, taken in conjunction with the appended drawings in which.

DESCRIPTION OF THE PREFERRED EMBODIMENTS

In general terms, the present invention concerns adding powdered magnesium to the aqueous magnesia slurry used to produce a separating agent in connection with the texture-annealing step in the production of grain-oriented silicon electrical steel.

Without wishing to be bound by any theory, we believe that during the texture annealing of silicon steel, there are water vapor, sulphur dioxide, and oxygen generated by the decomposition of $Mg(OH)_2$ and $MgSO_4.xH_2O$ components in the MgO coating, and these can lead to the oxidation of the steel. Coating defects are believed to be produced by the formation of iron and silicon oxides (principally FeO and $Fe_2SiO_4$) and the subsequent reduction of these oxides to metallic form during the later stages of the texturizing-annealing cycle. Moreover, having oxidizing conditions in the between-lap spaces during texture annealing is believed to increase the depth of the internal oxidation zone of the steel, by promoting further oxidation of the silicon alloying element in the steel, because the additional silica particles so generated impede the motion of domain walls and adversely affect the magnetic quality of the finished product.

In accordance with the present invention, the oxidation of the steel, the formation of coating defects, and the growth of the internal oxidation zone are prevented by adding to the coating mix, in the form of a fine powder and preferably in quantities just sufficient to render all of the oxidizing gases released by the coating constituents harmless to steel, a quantity of elemental magnesium. The magnesium is considerably more reactive with oxygen than with the steel, and it has a higher vapor pressure, which allows uniform distribution of reactive agent through the space between the coil laps. Moreover, it forms a non-passivating oxidation product, and one which is non-contaminating with respect to the magnesia coating of the steel.

Figure 1:
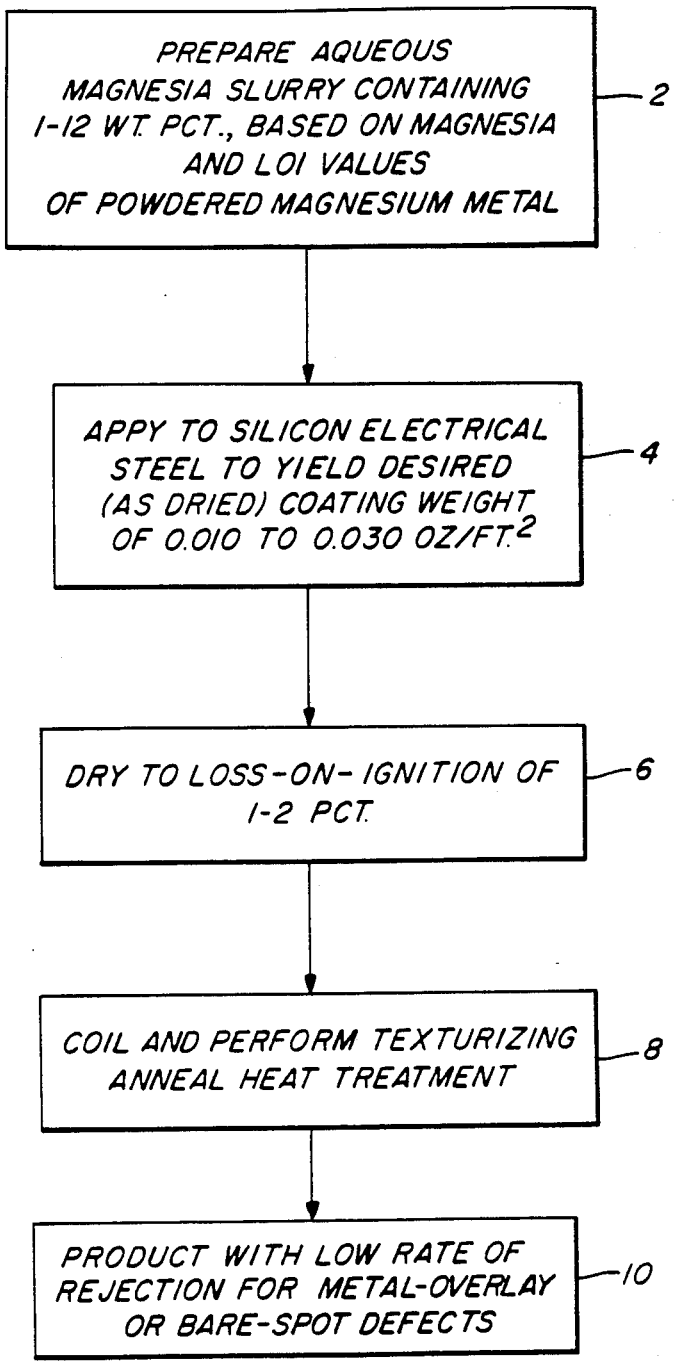
FIG. 1 is a flow diagram of the process according to the present invention.

The initial step in the practice of the invention in its method aspect is, as indicated in the block 2 of the attached FIG. 1, the preparation of an aqueous magnesia slurry containing 1 to 12 weight percent, based on magnesia, of powdered magnesium metal. To be somewhat more particular, there may be prepared a slurry containing 86.37 percent water, 12.97 weight percent magnesium oxide, 0.40 percent magnesium sulfate heptahydrate (Epsom Salts), and 0.26 weight percent of magnesium powder with a particle distribution of between minus 40 mesh to minus 320 mesh, as, for example, by mixing 1 pound of minus 200 mesh magnesium metal fines with 50 pounds of magnesia, and 600 grams of Epsom Salt, and 40 gallons of water. The particle size of the magnesium powder should be sufficiently small so as to maintain an ability to remain suspended in the slurry and for the magnesium particles to attach and remain attached to the coated strip while moving through a drying furnace and during coiling. Coarse magnesium particles may settle to the bottom of a slurry coating tank. Even if the slurry containing coarse magnesium particle is agitated in the tank, the particles will fall from the strip surface when the gravitational forces become greater than the bonding action of the applied coating.

Silicon steel strip can be coated with such a slurry by dipping the strip into the slurry tank at typical line speeds of 650 feet per minute. In the flow diagram of the attached FIG. 1, this is indicated by the block 4.

The next step is to dry the coating, which may be done by feeding the moving strip at some speed such as 300 to 700 feet per minute, e.g. 650 feet per minute, into a vertical 30-foot-high gas-fired furnace kept at 1200 to 1450 degrees F. depending on the strip speed through the furnace. In the flow diagram of the attached Figure, this is indicated by the block 6. The residence time of the strip in the drying furnaces is typically about 3 seconds, which yields a strip temperature at the furnace exit in the range of 250 degrees to 650 degrees F. The coating in its as-dried condition exhibits a loss on ignition of 1 to 3 weight percent, practically all of which can be attributed to water of hydration which is present with the magnesium oxide or the magnesium sulphate. It is impractical to remove this water of hydration by increasing the residence time in the drying furnace and the temperature achieved by the strip because of the danger of oxidizing the steel.

The steel is then coiled and texturize-annealed, as indicated in the block 8 of FIG. 1. In accordance with the invention, there is then obtained, as indicated in the block 10, a product with a low rate of rejection for coating defects such as metal-overlay or bare-spot defects.

Figure 2:
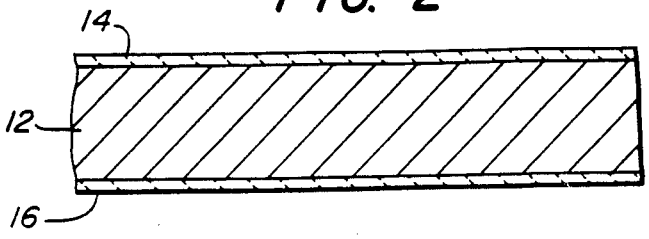
FIG. 2 is a cross-sectional view of an article made in accordance with the invention.

To illustrate the invention in its aspect as an article of manufacture, namely, the silicon-steel strip provided on both surfaces with separating-agent coating according to the present invention, there is provided a drawing, FIG. 2, which shows in cross-section a piece of silicon-steel strip 12 having on the opposite sides thereof layers 14 and 16 of MgO separating-agent coating containing added magnesium-metal powder.

The above-described process is less obvious to those skilled than it might initially appear. It is known that finely divided metal powders are, in general, materials whose use it is desirable to avoid. Metal powder (even iron) tends to be pyrophoric, i.e., tends to burn spontaneously when exposed to air. Thus, all such powders pose handling and safety problems, both for the producer and for the user thereof, which implies that such materials are also relatively expensive. This is particularly likely to be true of magnesium, which is somewhat more electro-positive than all of the other metals specifically mentioned in the above-cited Japanese patent. Moreover, there has not been, prior to the present invention, any assurance from the prior art that, even with the adoption of the measures taught in accordance with the present invention, there would be obtained the desirable results of the invention, such as a reduction the rate of rejection of product from something on the order of 20 to 40 percent down to a level on the order of 3 percent or less. It has not been evident to those skilled in the art that the economic advantages of such an improvement in the rejection rate could be obtained, especially with the use of any so low-cost and convenient method of obtaining the separating-agent composition as merely incorporating the magnesium metal powder in the aqueous magnesia slurry composition.

It can be observed that, at least in theory, the magnesium metal powder can be incorporated into the separating-agent composition in other ways that will suggest themselves to those skilled in the art, such as by applying the powder to a coated moving strip after it has left the drying furnace, e.g., with the use of a non-aqueous carrier.

In general, the addition of magnesium metal in amounts significantly greater than that necessary to combine with the oxidizing gases which are generated by decomposition of coating constituents during annealing is to be avoided. Excess magnesium metal, by reducing the silica on the surface of the steel to silicon, may prevent the formation of the desired insulating forsterite film and result in bare steel. The process according to the present invention will tolerate magnesium metal additions above that necessary by the Loss On Ignition (LOI). For example, if LOI indicates a need of about 2% addition of magnesium metal, an addition of up to 3% magnesium metal to the slurry will not lead to problems. However, an addition of 5% magnesium metal when LOI indicates a need for only an addition of 2% magnesium metal will produce unaccepted results because the excess magnesium metal will reduce the base coating and hence electrical insulation. The Loss On Ignition values are obtained after drying coated strip which is coated with the same slurry but before addition of magnesium metal.

Those skilled in the art will appreciate that, given the task of providing to the silicon-steel strip a separating-agent coating with a given weight of coating per unit area, various process parameters may be suitably adjusted or coordinated to achieve the desired result. When the coating is done by passing steel strip through a slurry bath at a given line speed, the coating weight can, within limits, be increased by making the slurry bath relatively more concentrated, i.e., richer in solids. Conversely, the coating weight can be decreased by using a slurry bath which is more dilute. Moreover, higher residence times in the slurry bath generally provide, within limits, greater coating weight, and lower residence times generally provide lower coating weights; this implies that the coating weight can be adjusted, at least to some extent, by altering the line speed being employed, to whatever extent that is possible, as a manner of providing whatever adjustment in coating weight is needed or desired. The line speed is to a considerable extent constrained by the requirements of the drying step, which must be conducted under conditions sufficiently severe to yield the desired drying action but, at the same time, not so severe as to cause unwanted oxidation of the silicon-steel strip. The set of values of the various parameters which is disclosed herein will, thus, suggest to those skilled in the art various conceivable modifications thereof which will yield equivalent results.

EXAMPLE

Work was done with an experimental coil of silicon electrical steel having the following chemical composition: Carbon 0.03%; manganese 0.068%; phosphorus 0.007%; sulphur 0.025%; silicon 3.19%; chromium 0.063%; nickel 0.460%; aluminum 0.0008%; molybdenum 0.037%; copper 0.27%; titanium 0.0014%; nitrogen 0.0061%; tin 0.017%; boron 0.0003%; oxygen 0.0042%; and the balance substantially iron. The above analysis is within the range of the commercially acceptable, and is in general typical, except for the nickel content, which is substantially higher than usual, a value closer to 0.1% being more common.

A coil of the above steel, 9 mils thick, was treated with magnesium oxide slurry; half of the coil was treated with a control slurry mix made from 50 pounds of magnesia, 600 grams of Epsom Salt, and 40 gallons of water. The other half was treated with the experimental slurry mix, containing the above ingredients plus 1 pound of minus 200 mesh magnesium metal fines.

Data were collected concerning the magnetic quality and the secondary grain size of the coil that was so treated, and these data are presented in the table below.

TABLE

| | Control Slurry Mix | | Experimental Slurry Mix | |
|---|---|---|---|---|
| Secondary Grain Size | 4.0 | 5.0 | 3.0 | 3.0 |
| Gage (mils) | 8.8 | 8.7 | 8.6 | 8.7 |
| WPP @ 13KB | .338 | .322 | .312 | .313 |
| WPP @ 15KB | .472 | .458 | .440 | .442 |
| WPP @ 17KB | .718 | .702 | .676 | .698 |
| VA/lb @ 15 | .641 | .644 | .619 | .643 |
| VA/lb @ 17 | 1.828 | 1.802 | 1.826 | 2.098 |

TABLE-continued

| | Control Slurry Mix | | Experimental Slurry Mix | |
|---|---|---|---|---|
| Mu @ 104 | 1824 | 1831 | 1827 | 1820 |
| H @ 200B | .0163 | .0162 | .0142 | .0141 |

The above data demonstrate that, at least, the use of the experimental slurry mix containing the magnesium metal did not appreciably detrimentally affect the magnetic properties; indeed, the magnetic properties seem to have been slightly improved, possibly because of the slightly more favorable grain size. At the same time, the core-loss values indicated above are, on the whole, very poor for a grain-oriented silicon steel, and this believed to be chiefly attributable to the relatively high nickel content of the steel.

Somewhat more importantly, when the product was scrubbed after the texturizing anneal, and inspected with respect to the coating quality, the portion of the coil which was coated with the control slurry mix containing no addition of magnesium metal had a very heavy annealing pattern and scattered metal overlay and bare spots throughout, i.e., it would have been rejected as commercial product on that ground alone. On the other hand, the coating quality for the portion of the coil which was treated with the experimental slurry mix, the one containing a 2 percent by weight addition of magnesium metal fines, based on the amount of magnesia present, exhibited an excellent coating quality throughout.

Experimental data were obtained to demonstrate the performance of the invention by a series of mill trials conducted at various times over a period of weeks, with the use of different MgO coating lines, gages of steel, proportions of added magnesium metal powder, suppliers of magnesia, and drying-furnace temperatures.

The fraction of the samples found satisfactorily free of coating defects out of a total number of samples scrubbed and examined were surprisingly high. The invention has brought about a considerable improvement in respect to avoiding rejections of product because of coating defects. Of the samples examined, only 3 percent of the 9-mil and 9 percent by the 7-mil samples were rejected, and this needs to be compared with our prior experience, using no magnesium metal, of typically having percentages of rejection for coating defects of 20 or 30 percent (seldom as low as 15 percent, and once as high as 61 percent).

While we have shown and described herein certain embodiments of our invention, we intend to cover as well any changes or modifications therein which may be made without departing from its spirit and scope.

We claim as our invention:

1. In a method of preparing silicon-steel strip for texturizing annealing which comprises passing said strip at a line speed of 300 to 700 feet per minute through a slurry bath consisting principally of water, magnesium oxide, and magnesium sulphate heptahydrate under conditions to yield an as-dried coating weight of 0.010 to 0.050 ounces per square foot, then drying said strip while passing it through a tower furnace at the same line speed to obtain steel strip coated with separating agent containing 1 to b 3 weight percent of water of hydration, the improvement which consists in including in said slurry a quantity of magnesium metal powder effective to prevent the development of coating defects on the surface of said steel during a subsequent coiling and texture-annealing treatment.

2. An improvement according to claim 1, wherein the proportion of magnesium metal powder used, compared to the magnesium oxide, is 1 to 12 percent by weight based on Loss On Ignition values.

3. An improvement according to claim 2, wherein the magnesium metal powder comprises approximately 2.0 percent by weight of the magnesium oxide.

4. A method of finishing the processing of grain-oriented silicon containing electrical steel in strip form which comprises the steps of:

applying to said strip a separating-agent coating by passing said strip through a slurry bath comprising principally 86 to 89 weight percent water, 12 to 14 weight percent finally divided magnesium oxide, and up to 1 weight percent of magnesium sulphate heptahydrate, under conditions to afford an as-dried coating weight of 0.010 to 0.050 ounces per square foot;

providing along with said separating-agent coating a quantity of magnesium metal powder effective to prevent the development of coating defects on the surface of said steel during a subsequent annealing thereof;

coating said strip; and subjecting said strip to a texturizing annealed heat treatment.

5. A method as defined in claim 4, wherein the amount of magnesium metal powder provided along with said separating-agent coating is 1 to 12 weight percent, based upon the weight of the magnesium oxide and a Loss On Ignition values.

6. The method according to claim 4 wherein said magnesium metal powder is defined within a size range of minus 50 to minus 320 mesh.

7. The method according to claim 4 wherein said magnesium metal powder is defined within a size of minus 200 mesh.

8. A method as defined in claim 4, wherein the amount of magnesium metal powder provided along with said separating-agent coating is about 2 weight percent, based upon the weight of the magnesium oxide.

9. A method as defined in claim 4, wherein the said magnesium metal powder is minus 200 mesh and is provided along with the other ingredients of said separating-agent coating by being added to an aqueous slurry of magnesium oxide, magnesium sulfate and water.

10. A method as claimed in claim 9, wherein the amount of magnesium metal powder provided along with said separating-agent coating is 1 to 12 weight percent, based upon the weight of the magnesium oxide and Loss On Ignition Values.

11. A method as defined in claim 9, wherein the amount of magnesium metal powder provided along with said separating-agent coating is about 2 weight percent, based upon the weight of the magnesium oxide.

* * * * *